US012064045B2

(12) United States Patent
Fuglevand

(10) Patent No.: US 12,064,045 B2
(45) Date of Patent: Aug. 20, 2024

(54) APPARATUS FOR CARRYING A CONTAINER

(71) Applicant: Mark Fuglevand, Cerritos, CA (US)

(72) Inventor: Mark Fuglevand, Cerritos, CA (US)

( * ) Notice: Subject to any disclaimer, the term of this patent is extended or adjusted under 35 U.S.C. 154(b) by 0 days.

(21) Appl. No.: 17/714,066

(22) Filed: Apr. 5, 2022

(65) Prior Publication Data

US 2023/0309727 A1 Oct. 5, 2023

(51) Int. Cl.

| | |
|---|---|
| ***A47G 21/08*** | (2006.01) |
| ***A45F 5/10*** | (2006.01) |
| ***A47G 23/02*** | (2006.01) |

(52) U.S. Cl.

CPC ..... *A47G 23/0216* (2013.01); *A45F 5/102* (2013.01); *A45F 2200/0583* (2013.01)

(58) Field of Classification Search

CPC ..... A47G 23/0225; A47G 23/0216; A47G 21/08; A47G 19/2266; A47G 19/2272; A47G 23/0208; B65D 25/32; A47F 5/0006

See application file for complete search history.

(56) References Cited

U.S. PATENT DOCUMENTS

| | | | | | |
|---|---|---|---|---|---|
| 505,837 | A * | 10/1893 | Lewis | A47G 25/32 | 211/83 |
| 1,285,095 | A * | 11/1918 | Fisher | A47J 45/10 | 220/759 |
| 2,654,628 | A * | 10/1953 | Klante | A47G 23/0208 | 294/87.28 |
| 2,864,575 | A * | 12/1958 | Stewart | A61J 9/0661 | 248/302 |
| 3,151,798 | A * | 10/1964 | Meagher | A47G 23/0216 | D7/394 |
| 4,131,259 | A * | 12/1978 | Franks | A47G 7/044 | D6/535 |
| 4,957,259 | A * | 9/1990 | Wolf, Jr. | F16B 45/008 | 248/315 |
| 5,899,515 | A * | 5/1999 | Burns | B65D 71/50 | 294/87.28 |
| 7,641,157 | B2 * | 1/2010 | Kirkendall | A45F 3/44 | 248/156 |
| 8,220,655 | B2 * | 7/2012 | Millstein | A47G 23/0225 | 294/142 |
| D744,789 | S | 12/2015 | Millstein | | |

* cited by examiner

*Primary Examiner* — Adam J Waggenspack
(74) *Attorney, Agent, or Firm* — ALONZO & ASSOCIATES; Arlyn Alonzo

(57) ABSTRACT

Aspects of the disclosure are directed to apparatus for holding a mug. In accordance with one aspect, the apparatus includes an O-member; an elongated member connected to the O-member; and a U-member coupled to the elongated member. In accordance with another aspect, the apparatus includes an O-member; an elongated member connected to the O-member and a C-member connected to the elongated member.

14 Claims, 11 Drawing Sheets

APPARATUS FOR CARRYING A CONTAINER

TECHNICAL FIELD

This disclosure relates generally to the field of carrying a container, and, in particular, to an apparatus for holding and/or transporting a mug.

BACKGROUND

Containers, such as mugs, may be used to carry cold and hot drinks. For most examples, a mug is held by the mug handle using multiple fingers inserted through the mug handle. For example, 4 fingers of a person's hand may be secured through the mug handle while the thumb is placed on a top portion of the mug handle to provide stability while holding the mug. However, in instances when a person has limited hand mobility, the use of multiple fingers to secure a mug may be difficult. Thus, there's a need for an apparatus for carrying a mug using one finger.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

In one aspect, the disclosure provides an apparatus for carrying a container. Accordingly, an apparatus for holding a mug, the apparatus including an O-member; a first elongated member connected to the O-member; and a U-member coupled to the first elongated member. In one example, the apparatus further includes a C-member, wherein the C-member is connected to the first elongated member. In one example, the first elongated member includes a first end and a second end, wherein the first end is connected to the O-member and the second end is connected to the C-member. In one example, the C-member is a reversed C-member.

In one example, the apparatus further includes a second elongated member, wherein the second elongated member includes two ends. In one example, the C-member is connected to one of the two ends of the second elongated member and the U-member is connected to a second of the two ends of the second elongated member. In one example, the apparatus further includes an arc-member, wherein the arc-member is positioned adjacent to the first elongated member and the O-member.

In one example, the U-member is configured to be inserted through a handle of a mug and configured to be secured around a lower half portion of the mug. In one example, the C-member includes a C-member opening configured for inserting the C-member through the handle of the mug. In one example, the apparatus further includes an arc-member, wherein the arc-member is positioned adjacent to the first elongated member and the O-member.

Another aspect of the disclosure provides an apparatus for holding a mug, the apparatus including an O-member; a first elongated member connected to the O-member; and a C-member connected to the first elongated member. In one example, the apparatus further includes a U-member, wherein the U-member is coupled to the C-member. In one example, the apparatus further includes a second elongated member, wherein the second elongated member includes two ends.

In one example, the C-member is connected to one of the two ends of the second elongated member and the U-member is connected to a second of the two ends of the second elongated member. In one example, the first elongated member includes a first end and a second end, wherein the first end is connected to the O-member and the second end is connected to the C-member. In one example, the C-member is a reversed C-member.

In one example, the apparatus further includes an arc-member, wherein the arc-member is positioned adjacent to the first elongated member and the O-member. In one example, the C-member includes a C-member opening configured for inserting the C-member through a handle of a mug. In one example, the U-member is configured to be inserted through the handle of the mug. In one example, the U-member is configured to be secured around a lower half portion of the mug.

These and other aspects of the present disclosure will become more fully understood upon a review of the detailed description, which follows. Other aspects, features, and implementations of the present disclosure will become apparent to those of ordinary skill in the art, upon reviewing the following description of specific, exemplary implementations of the present invention in conjunction with the accompanying figures. While features of the present invention may be discussed relative to certain implementations and figures below, all implementations of the present invention can include one or more of the advantageous features discussed herein. In other words, while one or more implementations may be discussed as having certain advantageous features, one or more of such features may also be used in accordance with the various implementations of the invention discussed herein. In similar fashion, while exemplary implementations may be discussed below as device, system, or method implementations it should be understood that such exemplary implementations can be implemented in various devices, systems, and methods.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

There are various ways to hold a container to ensure that the container is held securely. When the container contains content, such as liquid, it is important not to spill. In one aspect, the container is a mug which may contain a cold or hot beverage. Holding a mug with beverage content is mostly second nature to users with full hand and finger mobility. However, when a user has hand and/or finger mobility limitations, then the use of an apparatus may aid in holding and transporting a mug.

Figure 1:
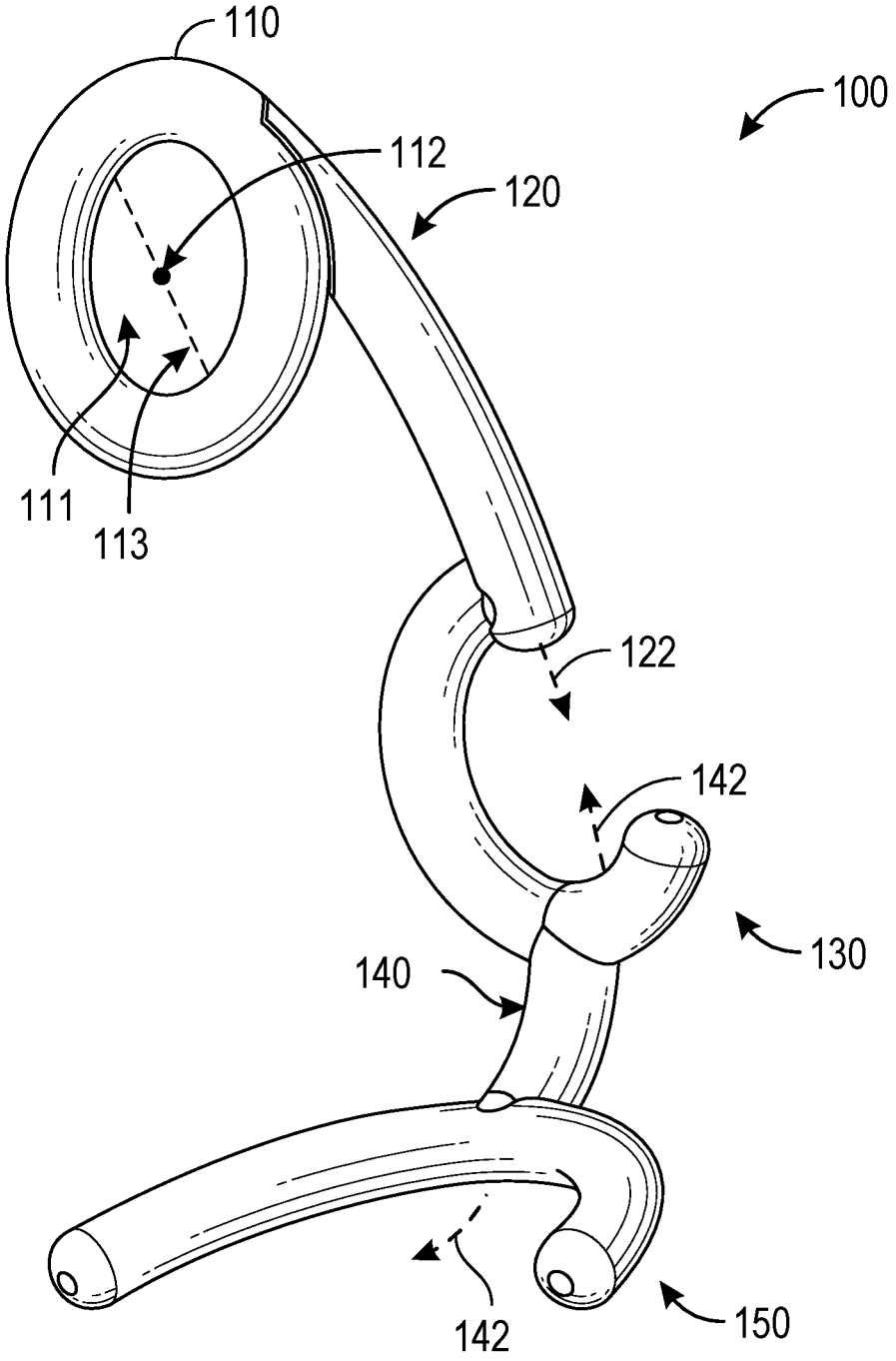
FIG. 1 illustrates a perspective view of an example apparatus for holding and transporting a mug.

FIG. 1 illustrates a perspective view of an example apparatus 100 for holding and transporting a mug. In one example, the apparatus 100 includes an O-member 110, a C-member 130 and a U-member 150. In one example, the O-member 110 is connected to the C-member 130 by a first elongated member 120. In one example, the C-member 130 is connected to the U-member 150 by a second elongated member 140. In one example, the U-member 150 has the shape of a semi-circle, such that if two U-members are placed adjacent to each other with their respective opening sections touching each other, the two U-members would form a full circle. In another example, the U-member 150 has the shape of a U such that if two U-members are placed adjacent to each other with their respective opening sections touching each other, the two U-members would form an elongated oval.

In one example, the first elongated member 120 is longer in length than the second elongated member 140. In one example, the first elongated member 120 is curved along a first axial length 122. In one example, the second elongated member 140 is curved along a second axial length 142. In one example, the curvature along the first axial length 122 is greater than the curvature along the second axial length 142. In another example, the curvature along the first axial length 122 is less than the curvature along the second axial length 142.

In one example, the O-member 110 includes a hole 111 with a hole center location 112. In one aspect, the hole center location 112 is a virtual location in an approximate center of the O-member 110. A diameter of the O-member (a.k.a. O-member diameter 113) passes through hole center location 112. In one aspect, the O-member diameter 113 is a virtual diameter. In one example, the O-member diameter 113 has a length of greater than the diameter of an average male person's thumb finger.

In one example, the C-member 130 has the same dimensions as the dimensions of the O-member 110. In another example, the C-member 130 has dimensions larger than the dimensions of the O-member 110. In yet another example, the C-member 130 has dimensions smaller than the dimensions of the O-member 110.

Figure 2:
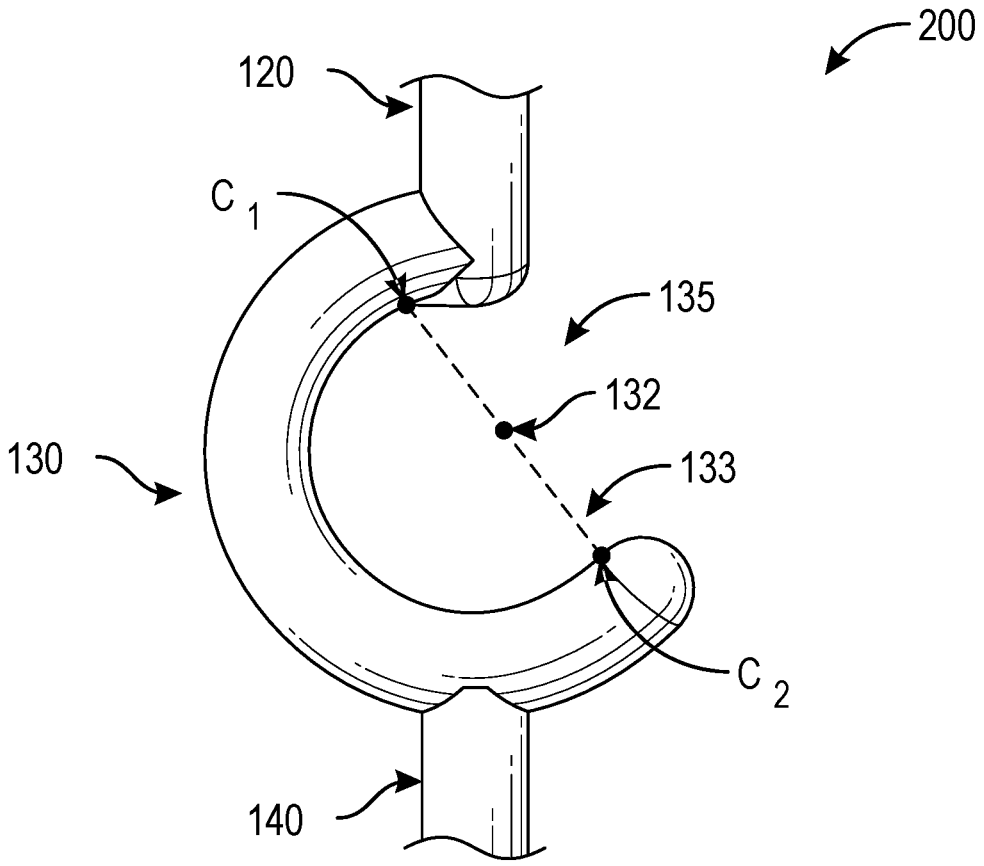
FIG. 2 illustrates a closeup view of a C-member.

FIG. 2 illustrates a closeup view 200 of the C-member 130. In one example, the C-member 130 includes a diameter (a.k.a. C-member diameter 133) measured along two points labeled as "$C_1$" and "$C_2$" on the C-member 130. In one aspect, the C-member diameter 133 is a virtual diameter. In one aspect, the C-member diameter 133 passes through a location (a.k.a. C-member center location 132). In one aspect, the C-member center location 132 is a virtual location in an approximate center of the C-member 130. In one example, the C-member 130 includes an opening (a.k.a. C-member opening 135). The dimension of the C-member opening 135 may vary to accommodate various mug sizes and the dimensions of the respective handles on mugs.

Figure 3:
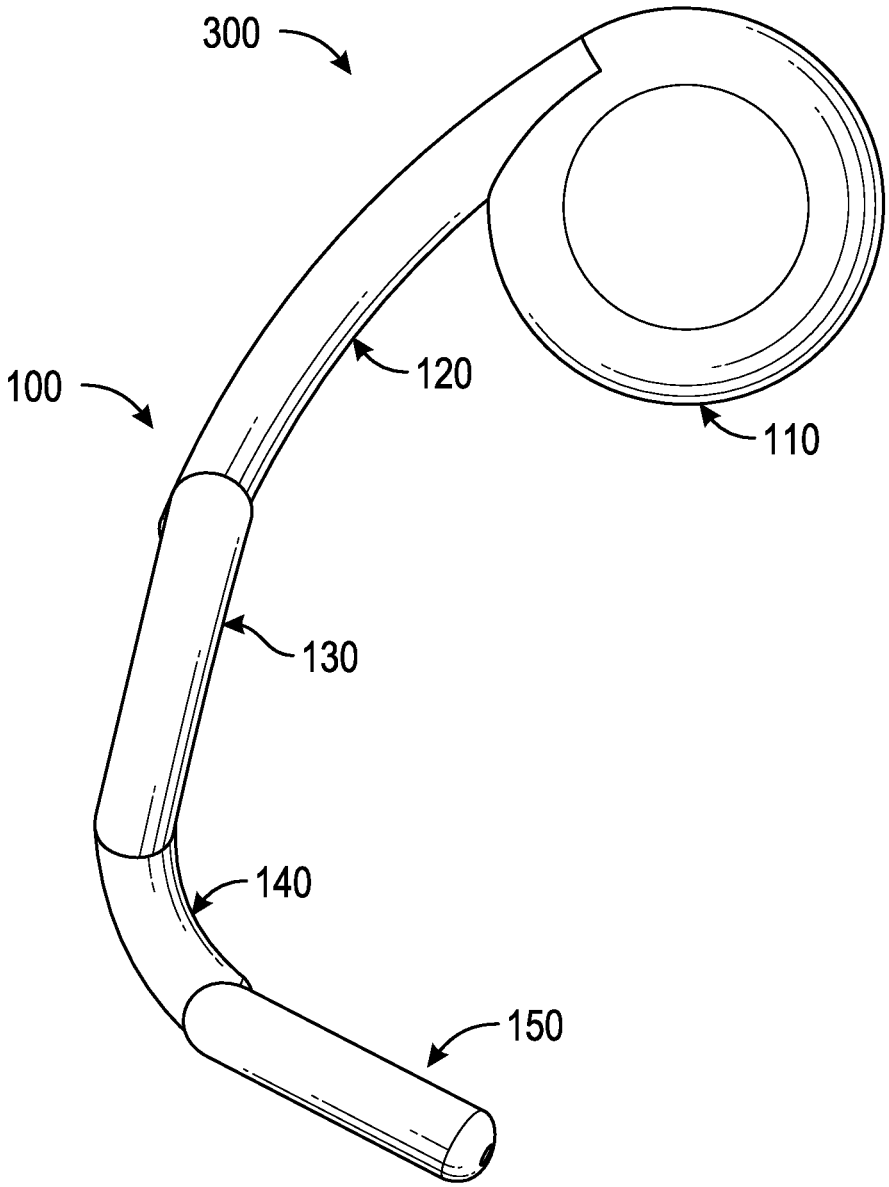
FIG. 3 illustrates a right side view of the example apparatus for holding and transporting a mug shown in FIG. 1.
Figure 4:
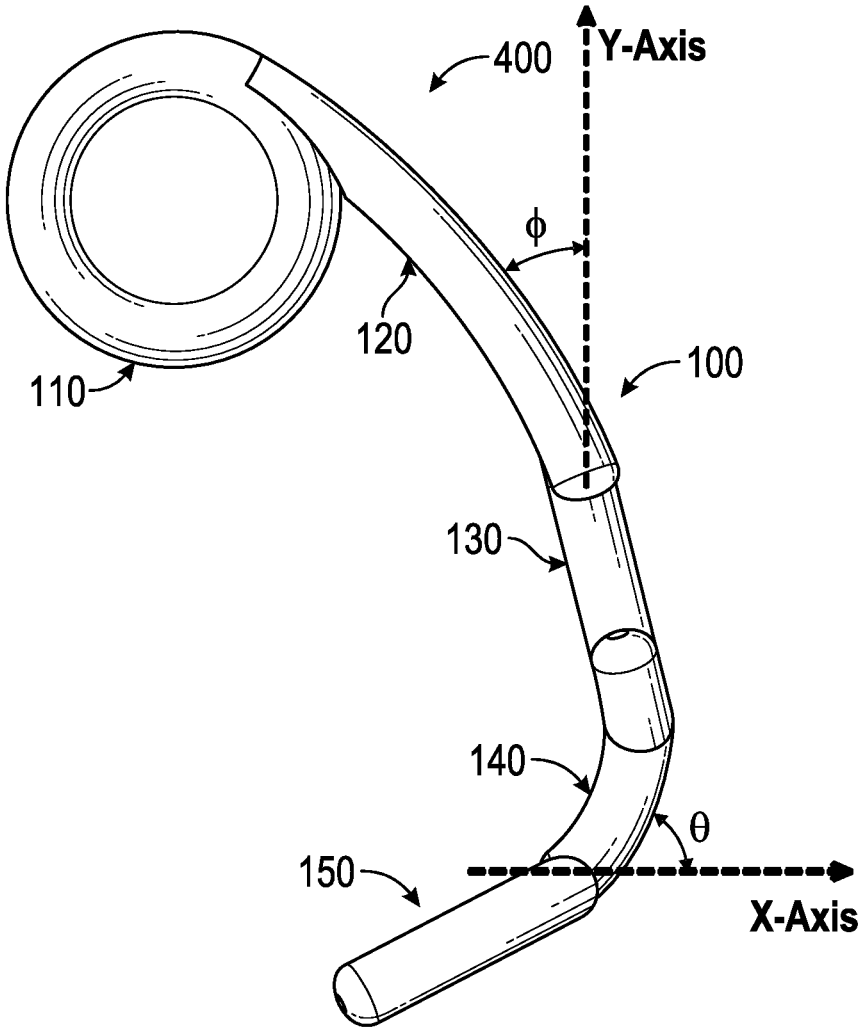
FIG. 4 illustrates a left side view of the example apparatus for holding and transporting a mug shown in FIG. 1.

FIG. 3 illustrates a right side view 300 of the example apparatus 100 for holding and transporting a mug shown in FIG. 1. FIG. 4 illustrates a left side view 400 of the example apparatus 100 for holding and transporting a mug shown in FIG. 1. Shown in FIG. 4 is a vertical axis (Y-axis) protruding from a center point (not shown) of one end of the first elongated member 120. In one example, the angle phi $\varphi$ is measured between one edge of the first elongated member 120 and the Y-axis as shown in FIG. 4. In one example, the measurement of the angle phi $\varphi$ is between 20-60 degrees. In another example, the angle phi $\varphi$ is measured between a center line of the first elongated member 120 and the Y-axis (not shown in FIG. 4). In this example, the measurement of the angle phi $\varphi$ is between 20-60 degrees.

Shown in FIG. 4 is a horizontal axis (X-axis) protruding from a center point (not shown) of one end of the second elongated member 140. In one example, the angle theta $\theta$ is measured between one edge of the second elongated member 140 and the X-axis as shown in FIG. 4. In one example, the measurement of the angle theta $\theta$ is between 45-85 degrees. In another example, the angle theta $\theta$ is measured between a center line of the second elongated member 140 and the X-axis (not shown in FIG. 4). In this example, the measurement of the angle theta $\theta$ is between 45-85 degrees.

Figure 5:
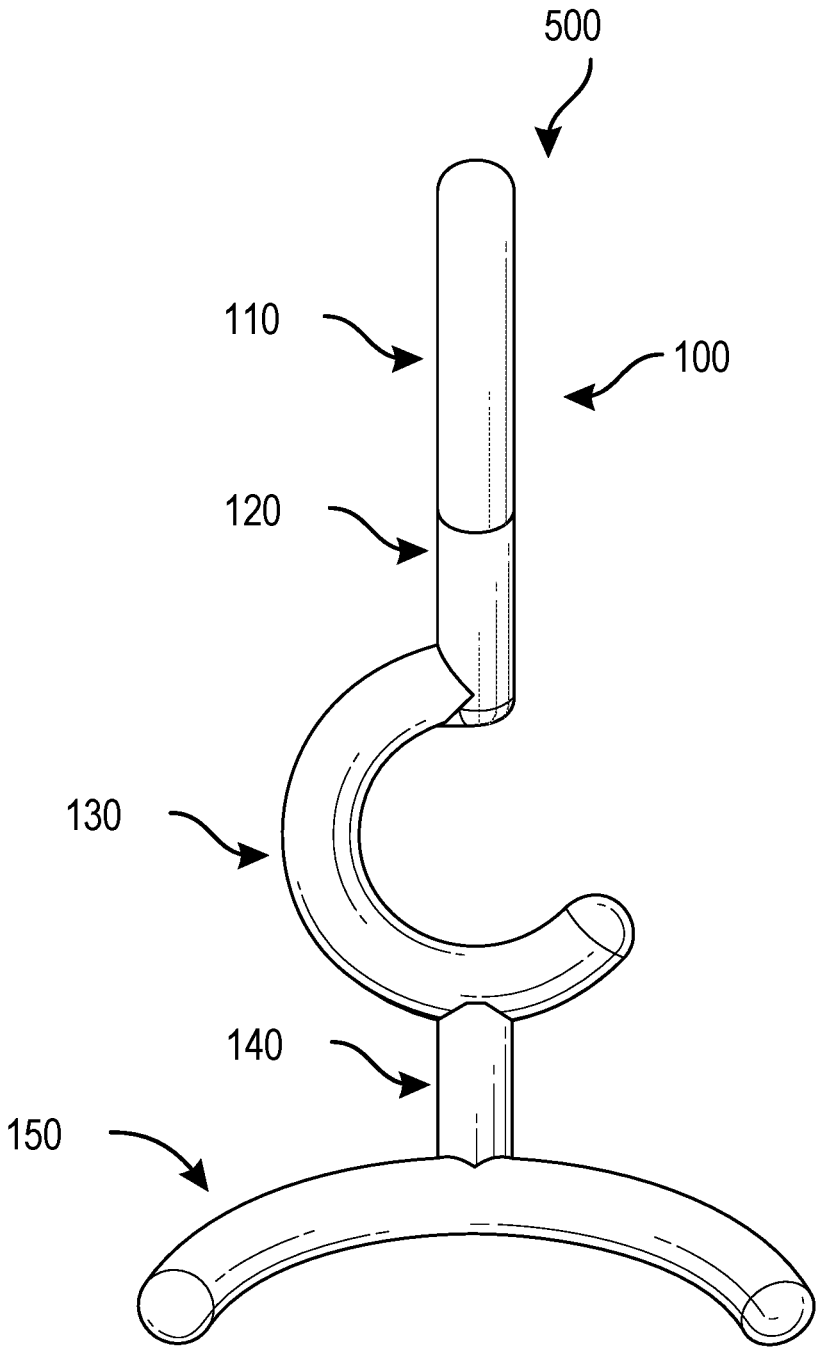
FIG. 5 illustrates a front view of the example apparatus for holding and transporting a mug shown in FIG. 1.

FIG. 5 illustrates a front view 500 of the example apparatus 100 for holding and transporting a mug shown in FIG. 1. In one aspect, the apparatus 100 with the C-member 130 allows a thumb to be inserted into the O-member 110 to hold on a mug and transport the mug.

Figure 6:
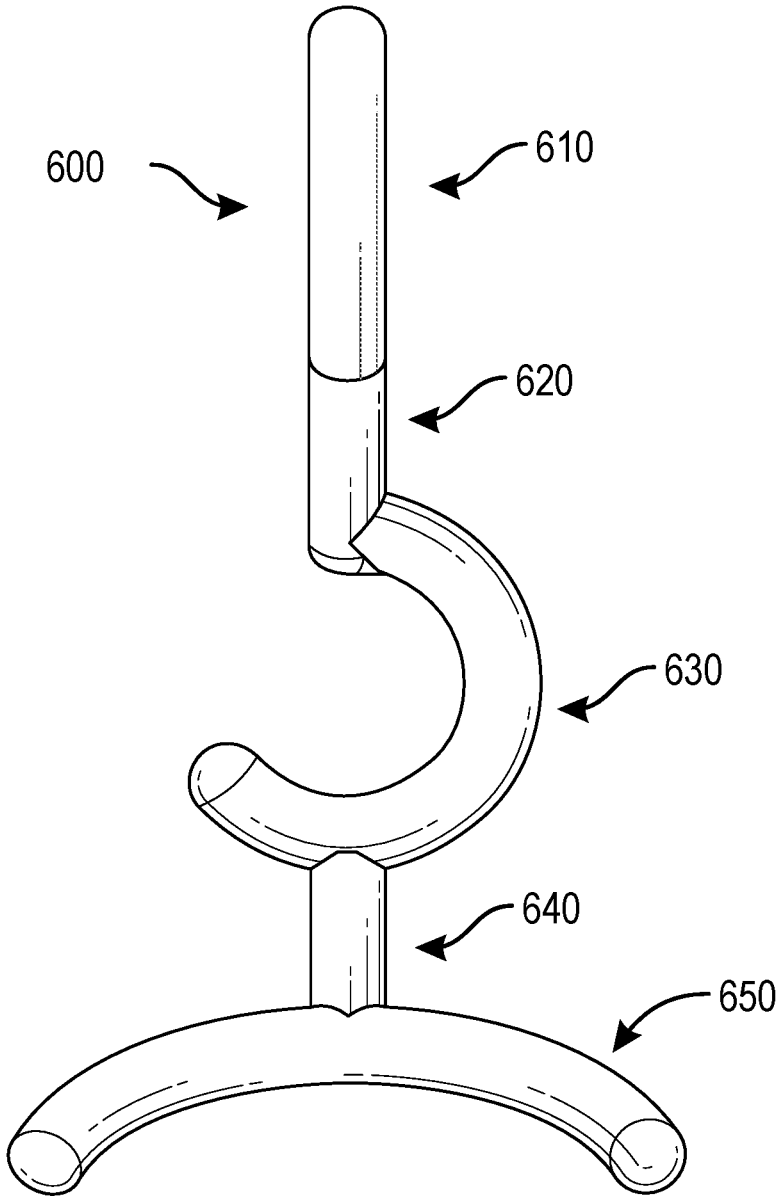
FIG. 6 illustrates a front view of an example apparatus for holding and transporting a mug with a reversed C-member.

FIG. 6 illustrates a front view of an example apparatus 600 for holding and transporting a mug with a reversed C-member 630. In one example, the apparatus 600 includes an O-member 610, a reversed C-member 630 and a U-member 650. In one example, the O-member 610 is connected to the reversed C-member 630 by a first elongated member 620. In one example, the reversed C-member 630 is connected to the U-member 650 by a second elongated member 640. In one example, the dimensions of the O-member 610 are similar to those of the O-member 110, the dimensions of the U-member 650 are similar to those of the U-member 150, the dimensions of the first elongated member 620 are similar to those of the first elongated member 120, the dimensions of the second elongated member 640 are similar to those of the second elongated member 140, and the dimensions of the reversed C-member 630 are similar to those of the C-member 130. In one aspect, the apparatus 600 with the reversed C-member 630 allows a thumb to be inserted into the O-member 610 to hold on a mug and transport the mug.

Figure 7:
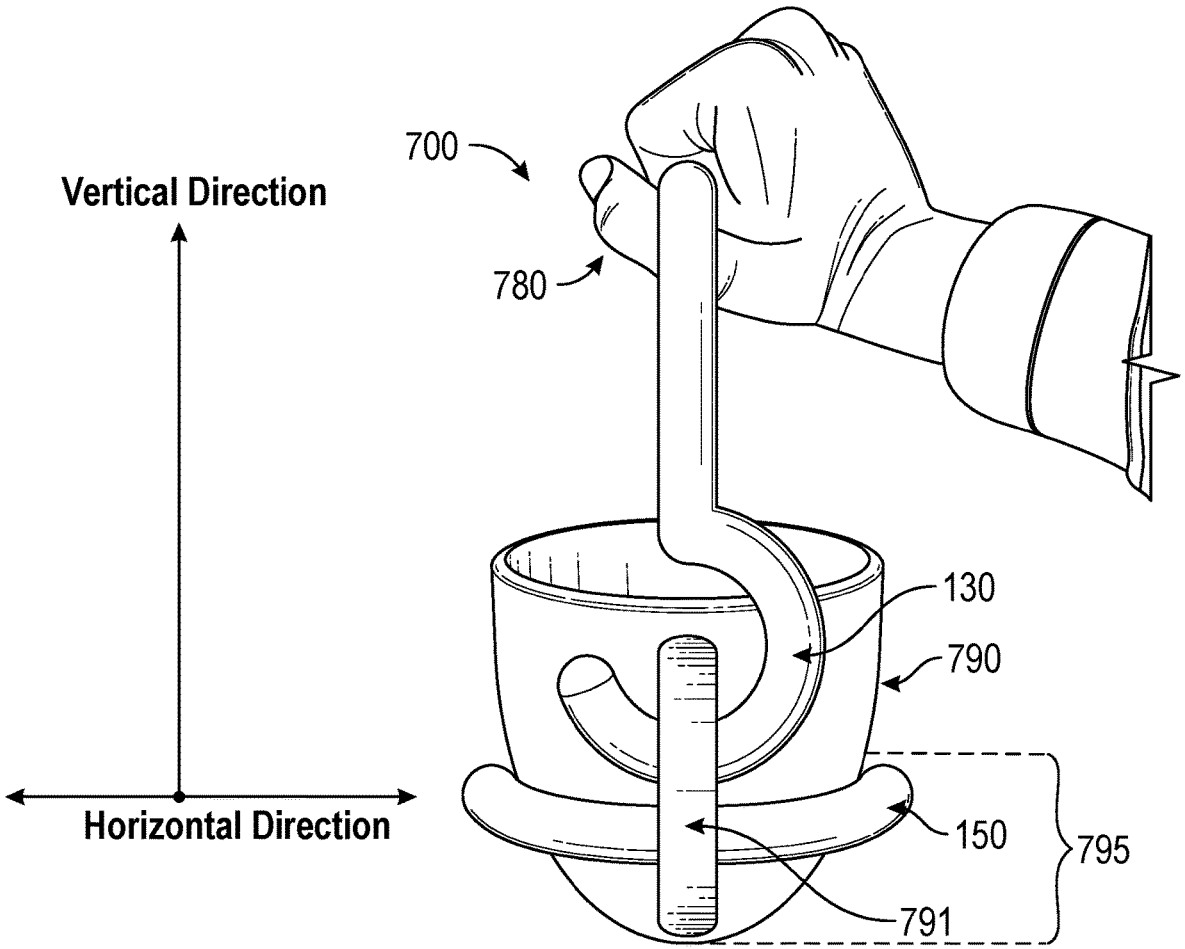
FIG. 7 illustrates an example direct view of a user's right-hand thumb inserted into a O-member to hold and transport a mug.
Figure 8:
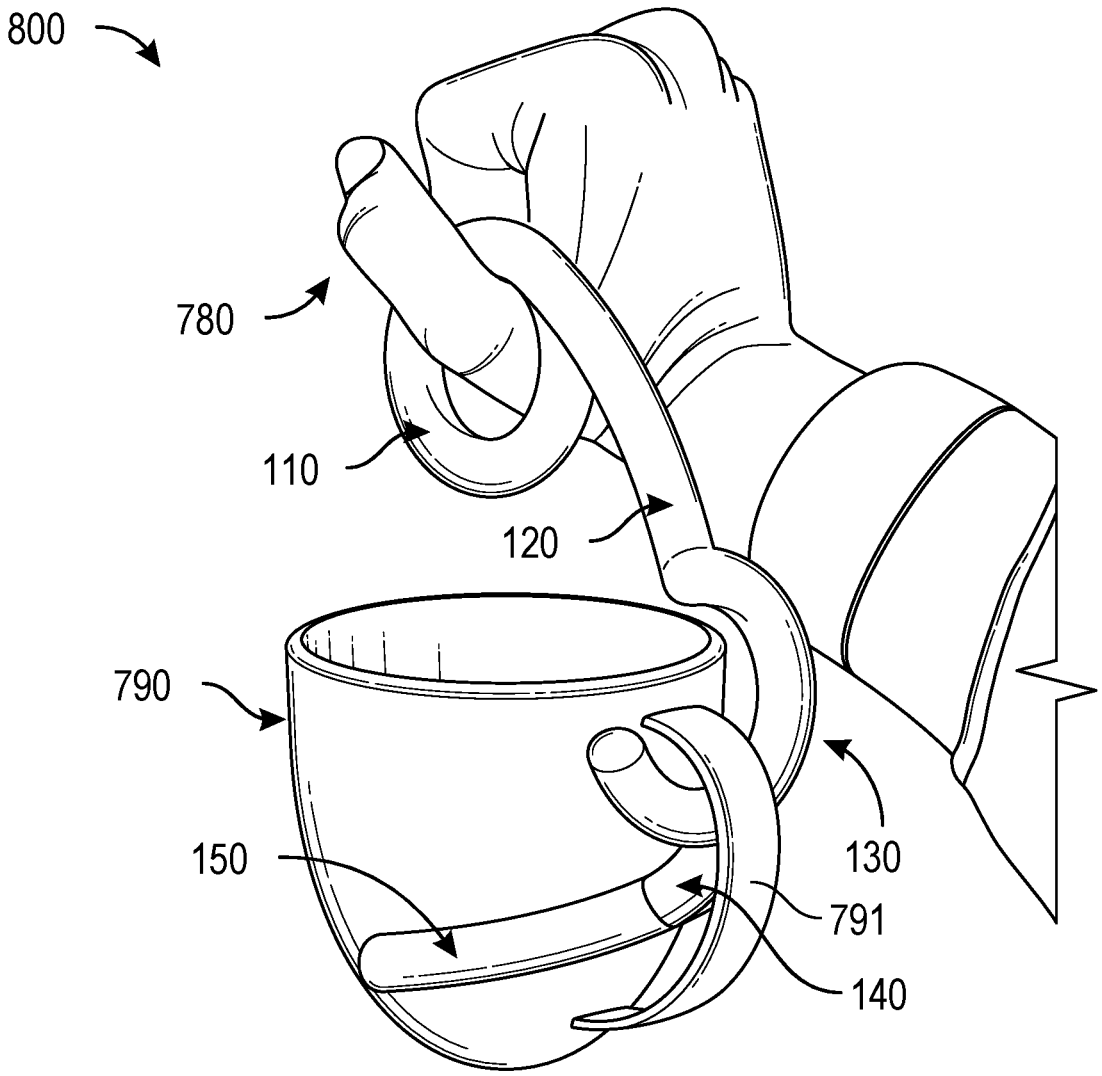
FIG. 8 illustrates an example left-side view of the user's right-hand thumb inserted into the O-member to hold and transport a mug.
Figure 9:
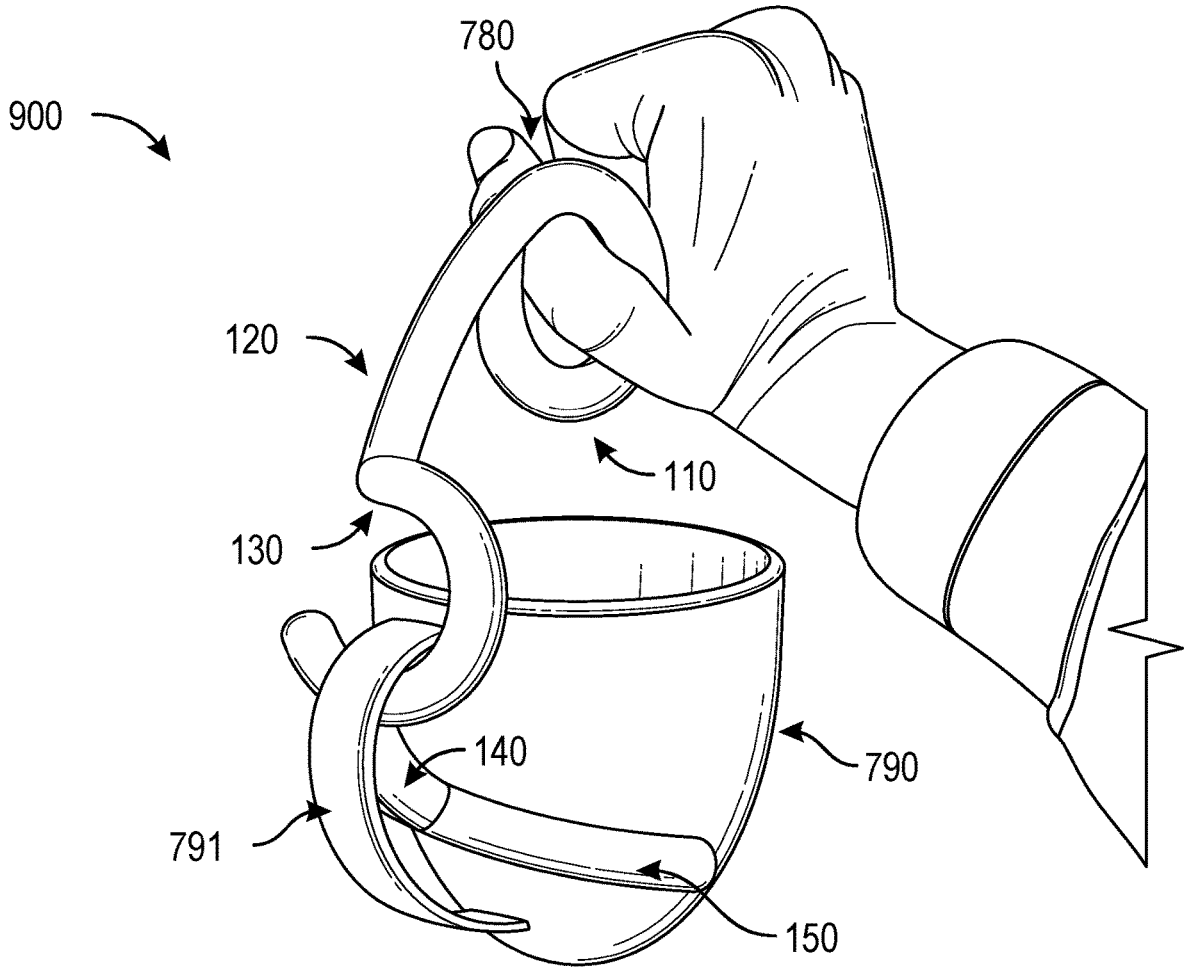
FIG. 9 illustrates an example right-side view of the user's right-hand thumb inserted into the O-member to hold and transport a mug.

FIG. 7 illustrates an example direct view 700 of a user's right-hand thumb 780 inserted into the O-member 110 to hold and transport a mug 790. As shown in FIG. 7, the mug 790 includes a handle 791. In one aspect, the C-member 130 is inserted through the handle 791 to provide vertical lift. In one aspect, the U-member 150 is inserted through the handle 791 to provide horizontal stability of the mug 790. FIG. 8 illustrates an example left-side view 800 of the user's right-hand thumb 780 inserted into the O-member 110 to hold and transport a mug 790. FIG. 9 illustrates an example right-side view 900 of the user's right-hand thumb 780 inserted into the O-member 110 to hold and transport a mug 790.

Figure 10:
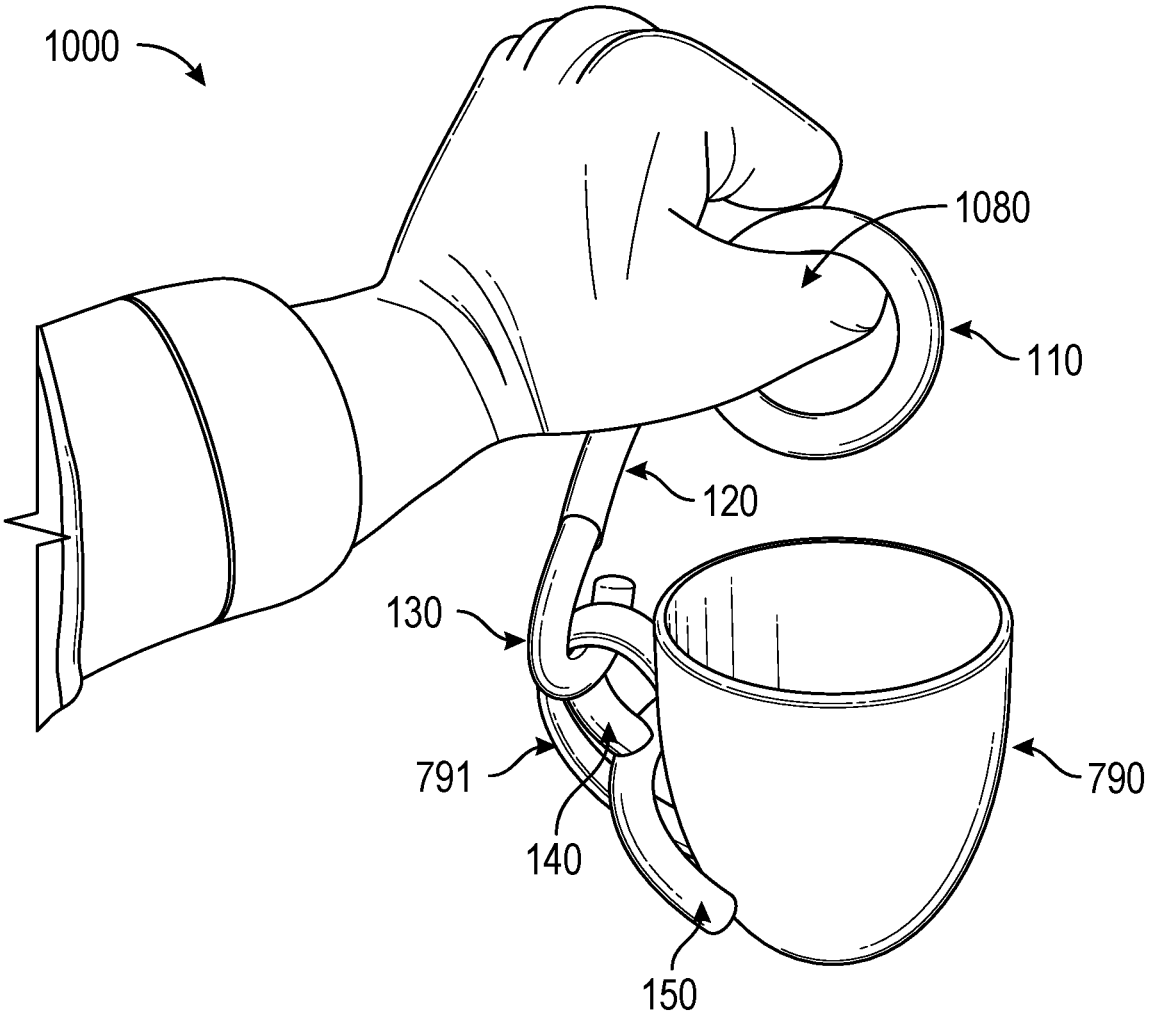
FIG. 10 illustrates an example right-side view of the user's left-hand thumb inserted into the O-member to hold and transport a mug.

In one aspect, the apparatus 100 may be used with a user's left hand. For example, FIG. 10 illustrates an example right-side view 1000 of the user's left-hand thumb 1080 inserted into the O-member 110 to hold and transport a mug 790. Although not shown with a mug, the example apparatus 600 for holding and transporting a mug with a reversed C-member 630 may be used with a user's right hand or left hand. In one aspect, the use of the apparatus 100 or the apparatus 600 is based on user preference.

Figure 11:
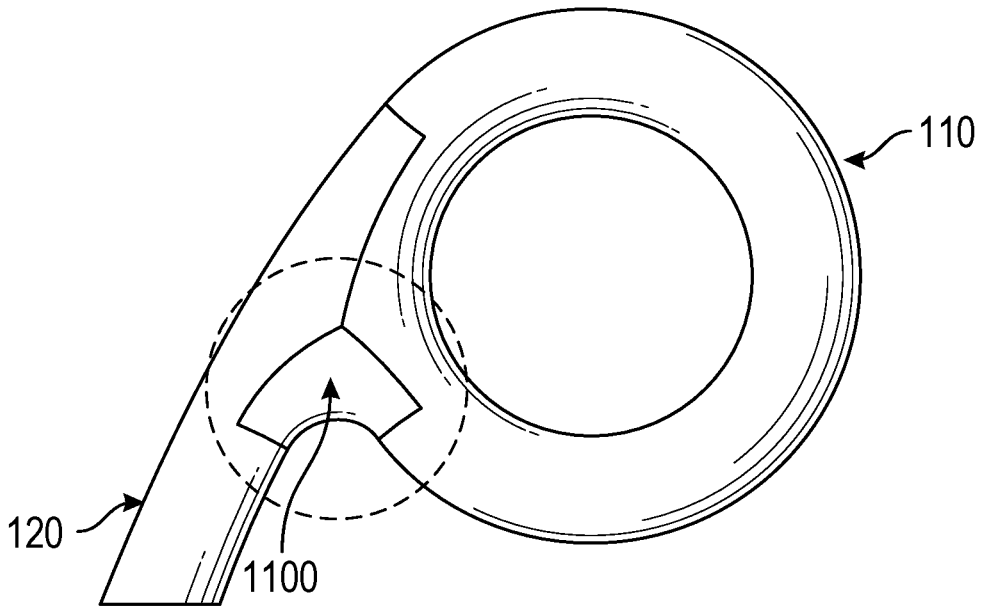
FIG. 11 illustrates an example arc-member.

FIG. 11 illustrates an example arc-member 1100. In one example, as shown in FIG. 4, the arc-member 1100 is positioned adjacent to the first elongated member 120 and the O-member 110. In one example, the arc-member 1100 may make it easier to hold the apparatus 100 when using the apparatus 100 to hold/support the mug 790. In one example, the arc-member 1100 provides the user with an additional position on the apparatus 100 to hold the apparatus 100 where a user's finger may rest. In one example, if the position of the mug 790 has too much pitch when the apparatus 100 is holding the mug 790, the arc-member 1100 may provide additional stability.

The apparatus 100, 600 may accommodate various dimensions. In one aspect, the dimensions of the apparatus 100, 600 are dependent on the dimensions of the mug 790. Some examples of dimensions of the apparatus 100, 600 are as follows:

- Thickness dimension of each of the following: O-member 110, first elongated member 120, C-member 130, reversed C-member 630, second elongated member 140, and/or U-member 150 may be in a range of 10 mm-14 mm, for example, 12 mm.
- Diameter dimension of the O-member 110 may be in a range of 40 mm-50 mm, for example, 45 mm.
- Length of the first elongated member 120 may be in a range of 73 mm-83 mm, for example, 78 mm.
- Diameter dimension of the C-member 130 (also, reversed C-member 630) may be in a range of 42 mm-52 mm, for example, 47 mm.
- Length of the second elongated member 140 may be in a range of 28 mm-34 mm, for example, 31 mm.
- Diameter dimension of the U-member 150 may be in a range of 88 mm-94 mm, for example, 91 mm In one aspect, the apparatus 100, 600, allows a user with limited hand dexterity the ability to secure a mug full of content, for example, liquid content, and transport the mug from one location to another location with just one finger. In one example, the U-member 150 is secured around a lower half portion 795 (as shown in FIG. 7) of the mug 790 to provide support at the lower half portion 795. In one example, the U-member 150 being secured around the mug 790 provides horizontal stability to the mug 790 as it is transported from one location to another location. One skilled in the art would understand that the lower half portion 795 as shown in FIG. 7 is an approximate indication. That is, in one example, the lower half portion 759 may be approximately half of the mug volume. In another example, the lower half portion 759 may occupy more than half of the mug volume. And, in yet another example, the lower half portion 759 may occupy less than half of the mug volume.

In one example, through the C-member opening 135, the C-member 130 (or the reversed C-member 630) is inserted through the handle 791 of the mug 790 to provide lifting (e.g., vertical lifting) of the mug 790. In one example, the C-member 130 (or the reversed C-member 630) is inserted through the handle 791 after the U-member 150 is secured around the lower half portion 795 of the mug 790. In another example, the U-member 150 is secured around the lower half portion 795 of the mug 790 first and then the C-member 130 (or the reversed C-member 630) is inserted through the handle 791. Whether the C-member 130 (or the reversed C-member 630) is secured to the mug 790 before or after the U-member 150 is secured to the mug 790 may be a user's choice and/or may depend on the user's hand dexterity.

In one example, after the C-member 130 (or the reversed C-member 630) is inserted through the handle 791 and the U-member 150 is secured to the mug 790, a user may insert one finger (e.g., a thumb, an index finger or any other finger) through the hole 111 of the O-member 110 to hold, move and/or lift (i.e., transporting) the mug 790 from one location to another location. In one example, a user may insert one or more fingers through the hole 111 to hold, move and/or lift the mug 790.

In one aspect, the apparatus 100, 600, allows no contact between the user's finger(s) and the mug 790 to hold, move and/or lift the mug 790 from one location to another location. Since, in one example, a single finger is needed to hold, move and/or lift the mug 790, a user may use other fingers on either the same hand or a different hand for other activities, such as operating a wheelchair, etc.

In one example, portions of the apparatus 100, 600 may be made from plastic or rubber material. In another example, portions the apparatus 100, 600 may be made from ceramic. In yet another example, portions of the apparatus 100, 600 may be made from metal or metal alloys, e.g., aluminum. In one aspect, a significant portion of the material that makes up the apparatus 100, 600 is rigid in nature so as to provide a secure hold on the mug 790 and provide horizontal stability when the mug 790 is being moved and/or lifted from one location to another location. In on aspect, portions of the apparatus 100, 600 may be made from materials that are flexible to allow some bend. For example, the portions of the first elongated member 120 may be made from a material with some flexibility for bending to accommodate any limited hand dexterity of a user. In one example, the first elongated member 120 is made from flexible plastic or rubber material. In one example, portions or all of apparatus 100, 600 may be made from one or more of the following: Polyethylene terephthalate glycol (PETG), Acrylonitrile Butadiene Styrene (ABS), Acrylonitrile Styrene Acrylate (ASA), Polylactic Acid (PLA), Thermoplastic Polyurethane (TPU), Chloroprene Rubber (CR), Titanium (TI) and/or Aluminum (AI).

In one aspect, an apparatus for holding and transporting a mug includes an O-member, an elongated member and a U-member. For example, the O-member is connected to the elongated member and the elongated member is connected to the U-member.

In one example, the O-member includes a hole with a hole center location. And, the hole center location is a virtual location in an approximate center of the O-member. A diameter of the O-member (a.k.a. O-member diameter) passes through hole center location. In one aspect, the O-member diameter is a virtual diameter. In one example, the O-member diameter has a length of greater than the diameter of an average male person's thumb finger. And, a user may put a finger through the hole of the O-member to carry a mug. In this example, the U-member is inserted through a handle of the mug to provide stability of the mug as the mug is held or transported from one location to another location by the user.

In one aspect, the O-member, and U-member may be the O-member 110 and U-member 150, respectively, as illustrated, for example, in FIG. 1. In one aspect, the elongated member may be the first elongated member 120 as illustrated, for example, in FIG. 1.

In another aspect, an apparatus for holding and transporting a mug includes an O-member, an elongated member and a C-member, instead of a U-member. For example, the O-member is connected to the elongated member and the elongated member is connected to the C-member.

In one example, the C-member includes an opening (a.k.a. C-member opening). And, through the C-member opening, the C-member is inserted through a handle of a mug to provide stability to the mug as the mug is held or transported from one location to another location by the user. In one example, the C-member may be the C-member 130 as illustrated, for example, in FIG. 1. In another example, the C-member may be the reversed C-member 630 as illustrated, for example, in FIG. 6.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other.

One or more of the components, steps, features and/or functions illustrated in the figures may be rearranged and/or combined into a single component, step, feature or function or embodied in several components, steps, or functions. Additional elements, components, steps, and/or functions may also be added without departing from novel features disclosed herein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. An apparatus system comprising:

a container having a handle;

an O-shaped member, wherein the O-shaped member is positioned for insertion of a user's finger;

a first elongated member connected to the O-shaped member and hanging downwardly from the O-shaped member when the user's finger is inserted into the O-shaped member, wherein the first elongated member includes a C-shaped section hanging downwardly and extending substantially perpendicular to the O-shaped member and having an opening receiving the handle;

a second elongated member coupled to the C-shaped section and extending downwardly therefrom, the C-shaped section extending upwardly beyond its connection to the second elongated member; and a U-shaped member coupled to the second elongated member, wherein the U-shaped member is positioned to contact a side of the container, the U-shaped member extending substantially perpendicular to the O-shaped member and the C-shaped member.

2. The apparatus system of claim 1, wherein the first elongated member includes a first end and a second end, and wherein the first end is connected to the O-shaped member.

3. The apparatus system of claim 2, wherein the second elongated member includes two ends.

4. The apparatus system of claim 3, wherein the C-shaped section is connected to one of the two ends of the second elongated member and the U-shaped member is connected to a second of the two ends of the second elongated member.

5. The apparatus system of claim 4, further comprising an arc-member, wherein the arc-member is positioned adjacent to the first elongated member and the O-shaped member.

6. The apparatus system of claim 5, wherein the U-shaped member is positioned to be inserted through the handle of the container and positioned to secure around a lower half portion of the container.

7. The apparatus system of claim 1, further comprising an arc-member, wherein the arc-member is positioned adjacent to the first elongated member and the O-shaped member.

8. An apparatus system comprising:

a container having a handle;

an O-shaped member;

a first elongated member coupled to the O-shaped member and hanging downwardly from the O-shaped member when the user's finger is inserted into the O-shaped member, wherein the first elongated member includes a C-shaped section hanging downwardly and extending substantially perpendicular to the O-shaped member and having an opening receiving the handle and wherein the first elongated member extends upward from the C-shaped section in a first direction;

a second elongated member coupled to the C-shaped section and extending downwardly therefrom in the first direction, the C-shaped section extending upwardly beyond its connection to the second elongated member; and a U-shaped member coupled to the second elongated member, the U-shaped member extending substantially perpendicular to the O-shaped member and the C-shaped member.

9. The apparatus system of claim 8, wherein the second elongated member includes two ends.

10. The apparatus system of claim 9, wherein the C-shaped section is connected to one of the two ends of the second elongated member and the U-shaped member is connected to a second of the two ends of the second elongated member.

11. The apparatus system of claim 10, wherein the first elongated member includes a first end and a second end, wherein the first end is connected to the O-shaped member.

12. The apparatus system of claim 11, further comprising an arc-member, wherein the arc-member is positioned adjacent to the first elongated member and the O-shaped member.

13. The apparatus system of claim 12, wherein the U-shaped member is positioned to contact a side of the container.

14. The apparatus system of claim 12, wherein the U-shaped member is positioned to secure around a lower half portion of the container.

* * * * *